US005191773A

United States Patent [19]

Cassell

[11] Patent Number: 5,191,773

[45] Date of Patent: Mar. 9, 1993

[54] RECIRCULATING CHILLING APPARATUS WITH A SUBMERGED ELECTRIC MOTOR AND IMPELLER

[76] Inventor: Allan J. Cassell, 12 Leigh Street, Werribee, Victoria 3030, Australia

[21] Appl. No.: 700,131

[22] PCT Filed: Aug. 22, 1990

[86] PCT No.: PCT/AU90/00362

§ 371 Date: May 22, 1991

§ 102(e) Date: May 22, 1991

[87] PCT Pub. No.: WO91/02933

PCT Pub. Date: Mar. 7, 1991

[30] Foreign Application Priority Data

Aug. 22, 1989 [AU] Australia ..... PJ5878
Dec. 14, 1989 [AU] Australia ..... PJ7872

[51] Int. Cl.[5] ..... F25D 17/02

[52] U.S. Cl. ..... 62/373; 62/64; 62/342; 62/376; 62/392

[58] Field of Search ..... 62/64, 373, 376, 392, 62/342; 417/423.3

[56] References Cited

U.S. PATENT DOCUMENTS

| | | | |
|---|---|---|---|
| 2,128,784 | 8/1938 | Tull et al. | 62/376 |
| 2,144,985 | 1/1939 | Markley, Jr. | 62/376 |
| 2,169,042 | 8/1939 | Germe | 62/376 X |
| 2,179,898 | 11/1939 | Pfeiffer | 62/376 |
| 2,214,009 | 9/1940 | Boester, Jr. | 62/376 |
| 2,253,404 | 8/1941 | Tanner | 62/376 X |
| 2,256,971 | 9/1941 | Chamberlain | 62/376 X |
| 2,287,681 | 6/1942 | Hazard | 62/376 X |
| 2,436,426 | 2/1948 | Fish | 62/376 |
| 2,470,551 | 5/1949 | Fish | 62/376 |
| 2,546,417 | 3/1951 | Anglin | 62/376 X |
| 2,785,545 | 3/1957 | Pusey | 62/376 X |
| 3,049,890 | 8/1962 | Ruppel | 62/376 X |
| 3,468,136 | 9/1969 | Swenson et al. | 62/64 |
| 3,888,092 | 6/1975 | Fisher | 62/376 |
| 4,715,195 | 12/1987 | Kucza | 62/376 |

*Primary Examiner*—Henry A. Bennet
*Assistant Examiner*—Christopher B. Kilner
*Attorney, Agent, or Firm*—Larson and Taylor

[57] ABSTRACT

Apparatus for rapid chilling of bottles and cans having a main bowl (46) and an inner bowl (48) in the main bowl. A basket (90) is mounted in the inner bowl and is adapted to receive bottles (92) to be chilled. The inner bowl has an opening (66) at its lower end. An agitator (88) driven by a submerged motor (86) assists in the circulation of cooling fluid in the main bowl and the inner bowl. The inner bowl has openings (76) near its upper end. Cooling fluid passes through these openings and into the gap between the inner bowl and the main bowl. Refrigeration coils (80) cool the cooling fluid.

12 Claims, 6 Drawing Sheets

RECIRCULATING CHILLING APPARATUS WITH A SUBMERGED ELECTRIC MOTOR AND IMPELLER

This invention relates to improvements in chilling apparatus and refers particularly, though not exclusively, to apparatus for the relatively rapid chilling of articles such as, for example, bottles, cans, containers of foodstuffs or other products, sachets of foodstuffs or other products, or foodstuffs.

In commercial establishments such as, for example, restaurants, bistros, hotels, bars, and the like, there is a need to have food and beverages served chilled. One way of achieving this is to have large cool rooms or refrigeration cabinets where sufficient quantities of the product to be cooled can be stored so that the lowering of the temperature of the product can take place using standard refrigeration techniques. However, as most cool rooms are set to approximately +2° C., it can generally be expected to take some time for the beverages to be reduced to their desired temperature. With restaurants and the like establishments this can give rise to a significant problem, as such establishments have to anticipate the drinking requirements of their patrons and, with the range of beers, wines, etc. currently available, it can quite often be extremely difficult to have beverages chilled to the correct temperature ready for immediate serving.

In domestic situations the needs of the consumer are significantly less, especially in terms of the quantity of beverage to be chilled or cooled. Such a consumer will generally only need to cool a few containers of beverage for immediate use. For cooling on such a small scale, conventional refrigeration cabinets are both inefficient (in terms of cost) and not satisfactory, in that to achieve a quick chill effect, more often than not unwanted freezing of the beverages occurs.

The prior art arrangements have also suffered from the disadvantage that the normal form of refrigerating cabinet or cool room is relatively large and can require perhaps as long as from ten to twelve hours to cool bottles of beverage, in sufficient quantities, to a satisfactory temperature. A normal refrigeration cabinet or cool room, after the initial pull down, will run for approximately sixty per cent of the entire day but would run continuously for maybe an hour immediately after loading product at ambient temperature.

In the specification of Australian Patent Application Number 47155/85 of Castleton, Inc there is disclosed a method or apparatus for rapidly chilling or freezing product. However, the apparatus and method are extremely complex and are clearly designed with totally different objectives in mind. For international application PCT/AU89/00360 of Multichil Pty. Ltd. the chilling apparatus uses a pump to circulate the cooling fluid and thus involves the use of a complex refrigeration and circulatory system. Similar comments as to the complexity of the apparatus also apply to AU26106/30, U.S. Pat. No. 1,329,426, PCT/AU87/00361, AUB23225/84, and AU266814.

The invention therefore seeks to overcome the problems and disadvantages associated with the prior art by providing an arrangement which lends itself to the relatively quick chilling articles such as, for example, bottles, cans, or sachets of foodstuffs or other products, containers of foodstuffs or other products, or foodstuffs.

With the above in mind, the present invention provides apparatus for the relatively rapid chilling of articles, said apparatus including a refrigeration system; a container having a main bowl in which a cooling fluid is located; an inner bowl within said main bowl, said inner bowl having a side wall with at least one opening therethrough adjacent the top of said side wall to allow said cooling fluid to pass therethrough into a gap between said side wall and main bowl, said inner bowl having at least one hole therethrough at its lower end, said hole being operatively connected to said gap; circulations means in said main bowl or said inner bowl for assisting circulation of said cooling fluid; and cooling means in said main bowl for the cooling of said cooling fluid.

In order that the invention may be more clearly understood and put into practical effect there shall now be described preferred constructions of a chilling apparatus in accordance with the invention. The description is given by way of non-limitative example only and is with reference to the accompanying drawings. In the drawings.

Figure 2:
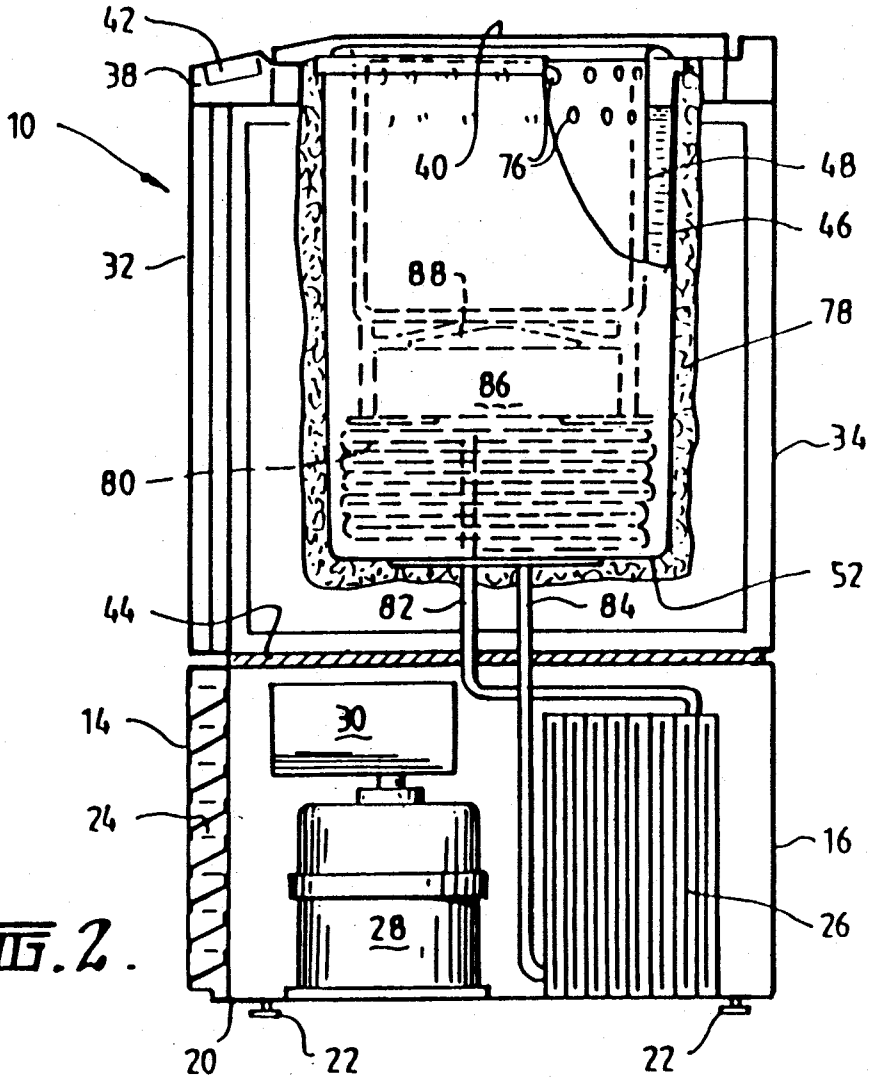
FIG. 2 is a vertical cross-sectional view of the embodiment of FIG. 1.
Figure 1:
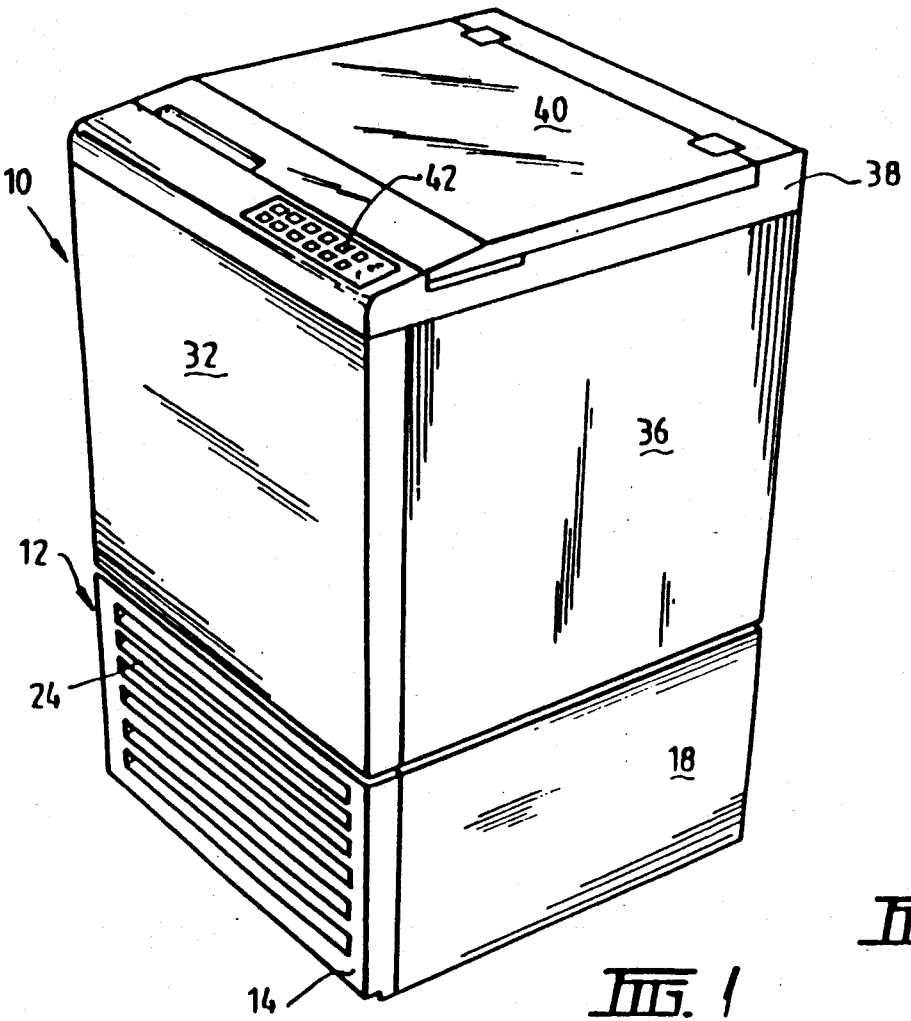
FIG. 1 is a perspective view of a first embodiment of chilling apparatus incorporating the preferred features of the present invention.
Figure 3:
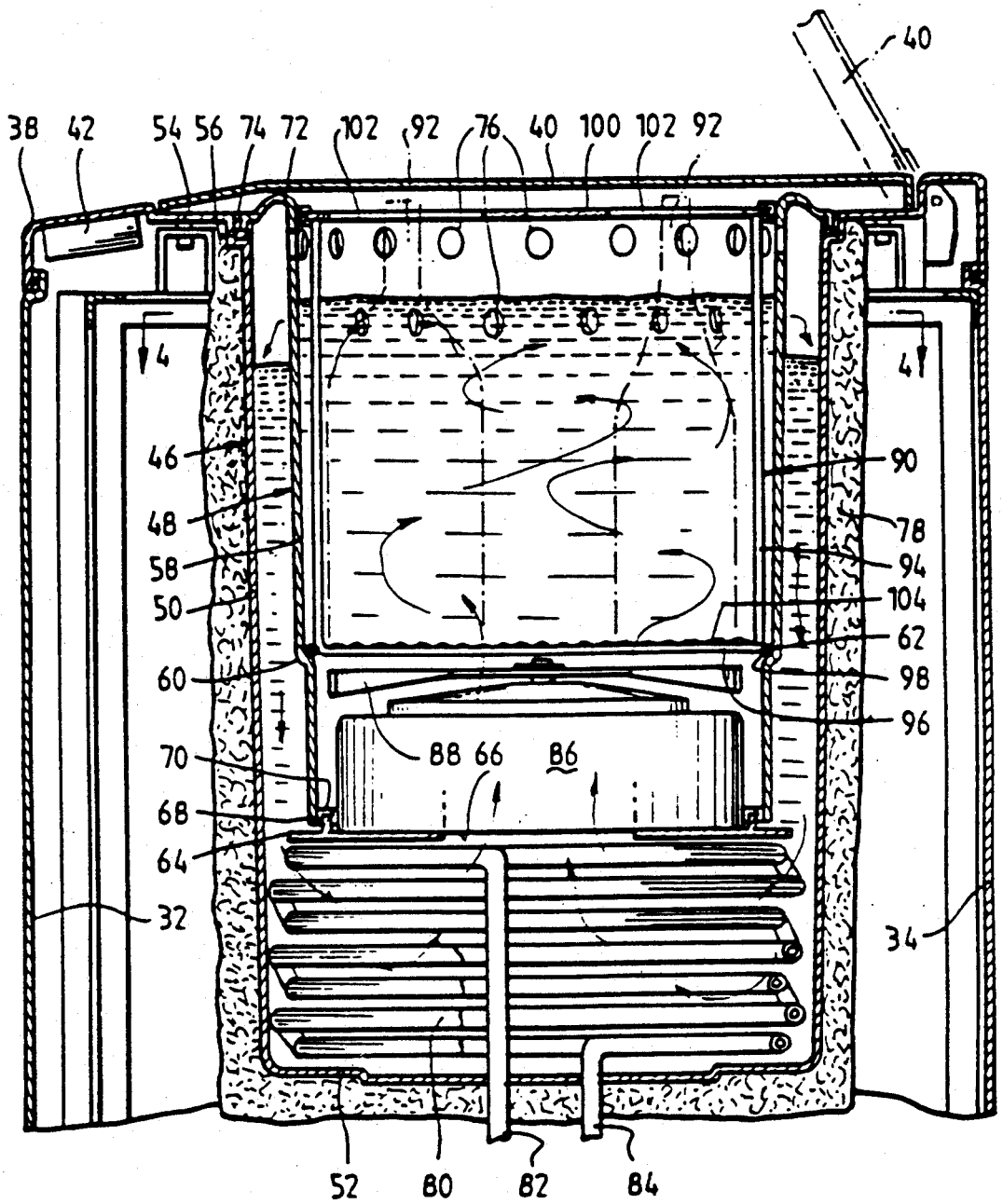
FIG. 3 is an enlarged vertical cross-sectional view of the upper part of the embodiment of FIG. 1.
Figure 4:
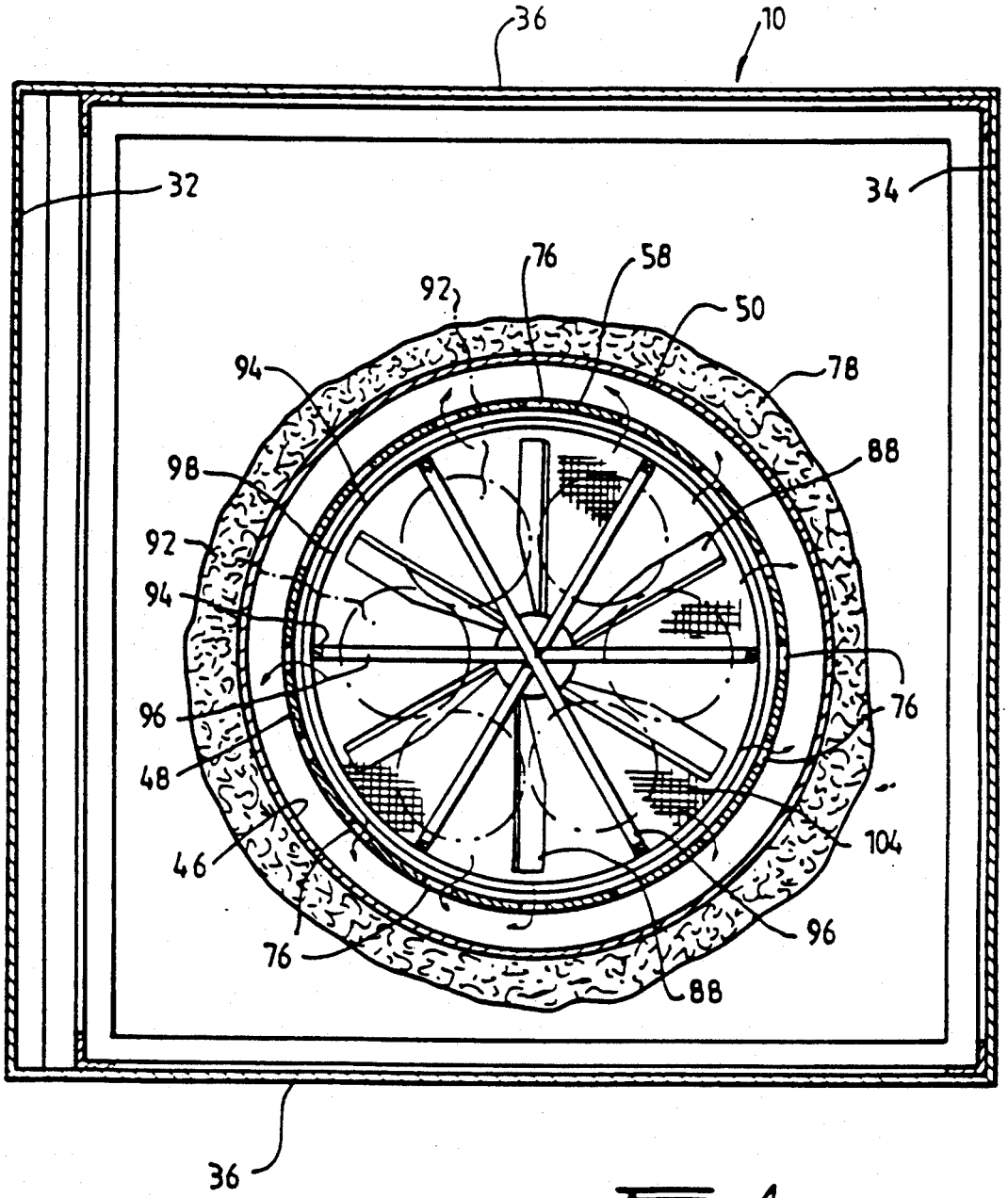
FIG. 4 is a full horizontal cross-sectional view along the lines of and in the direction of arrows 4—4 on FIG. 3.

To firstly refer to the embodiment of FIGS. 1 to 4, there is shown a chilling apparatus having an upper portion 10 and a lower portion 12. The lower portion 12 has four mutually perpendicular walls being a front 14, rear 16, and two sides walls 18. It also has a base 20 from which depend feet 22. The front wall 14 has a number of horizontal louvres 24 to enable cooling air to circulate into the lower portion 12. Mounted on the base is a refrigeration system of standard design and which includes a condenser 26, motor 28, compressor 30, and other componentry (not shown) of the refrigeration system. As the refrigeration system is standard and operates in a known way, it will not be described in any detail.

The upper portion 10 has four mutually perpendicular walls being a front 32, rear 34, and side walls 36. It also has a top 38 which includes a hinged lid 40, and a control panel 42. The base 44 of the upper portion 10 also separates the upper portion 10 from the lower portion 12.

Depending from the top 38 is a bowl 46 which may be integral with the top 38 (as shown) or as a separate item attached or secured to the top 38. The bowl 46 has mounted within it a second, smaller bowl 48. The bowl 46 has a side wall 50, an integral base 52 and a top 54. An intended portion 56 is provided at the junction of the side wall 50 and the top 54. The bowl 48 has a side wall 58 having a step 60 therein to provide a ledge 62 in the side wall 58. An annular base 64 is provided at the lower end of side wall 58, there being an opening 66 in the base. The base 64 is attached to the side walls 58 by an upwardly projecting lug 68 and a gasket 70. The upper end of the side wall 58 has a roll-over rim 72 adapted to engage in a gasket 74 located on the indented portion 56. The side wall 58 has a series of holes 76 therethrough below the rim 72. Insulation 78 may be provided surrounding the bowl 46.

Located in the bowl 46 on its base 52, but below base 64 of bowl 48 is a coil or series of coils 80 of tubing and which contains the refrigerant. As such it is connected to the condensing unit 26 by pipes 82, 84. In this way the coils are operatively connected to the refrigeration unit to provide the necessary chilling capabilities.

Mounted on base 64 is a motor 86 which drives an impellor or agitator 88. Releasably mounted inside bowl 48 is a basket 90 adapted to hold the articles to be chilled, in this instance bottles 92. The basket has a side wall 94 and an integral base 96. Extending outwardly from the junction of the side wall 94 and base 96 is a bead 98 which rests on ledge 62 so as to locate the basket 90 in position, and to maintain the base 96 of basket 90 above the agitator 88. The basket 90 may have a top 100 having openings 102 therethrough to allow the bottles 92 or the like to be placed inside the basket 90.

Preferably, the side wall 94 and base 96 of the basket are made of an open material such as, for example, a mesh, grid or the like so as to enable a fluid to freely pass therethrough.

In use, the bowl 46 is filled to a level below the holes 76 with a fluid capable of being chilled and being of food grade quality such that the use of the fluid in an unsealed container does not cause any difficulties. Good examples are those based on propylene glycol, sodium chloride solutions, or the like. By virtue of the refrigeration system and the coil 80, the fluid is chilled to a temperature of approximately −20° C. This is well below the +2° C. normally used in conventional cool rooms and refrigerators. Once the fluid is at operating temperature, the basket 90 with its contents 92 can be placed in position inside bowl 48. Due to the agitating and lifting motion of the motor 86 and agitator 88 of the contents 92, the fluid level rises to above the holes 76. The fluid therefore flows out through the holes 76 and falls down into the gap between the wall 50 of bowl 46 and wall 58 of bowl 48. The motor 86 is driving the agitator 88, which tends to force fluid up through the basket 90. This therefore causes fluid to flow upwardly through the opening 66 in base 64 and past the motor 86. This cools the motor 86. As the opening 66 is above the centre of coil 80, the fluid falling down from the openings 76 has to pass through the coil 80, to be drawn up into bowl 48. This again chills the fluid. The continual cycling of the fluid chills the contents 92 of the basket 90.

If desired a grille 104 or like means can be used to prevent the basket 90 and or any contents thereof contacting the agitator 88.

Tests have shown that a bottle of wine can be chilled in approximately four minutes when the fluid is at −20° C. Approximately one minute is taken to chill the glass of the bottle, and the three minutes to chill the contents. As the glass of the bottle is chilled, it continues to chill the wine even after the bottle is removed from the fluid.

Figure 5:
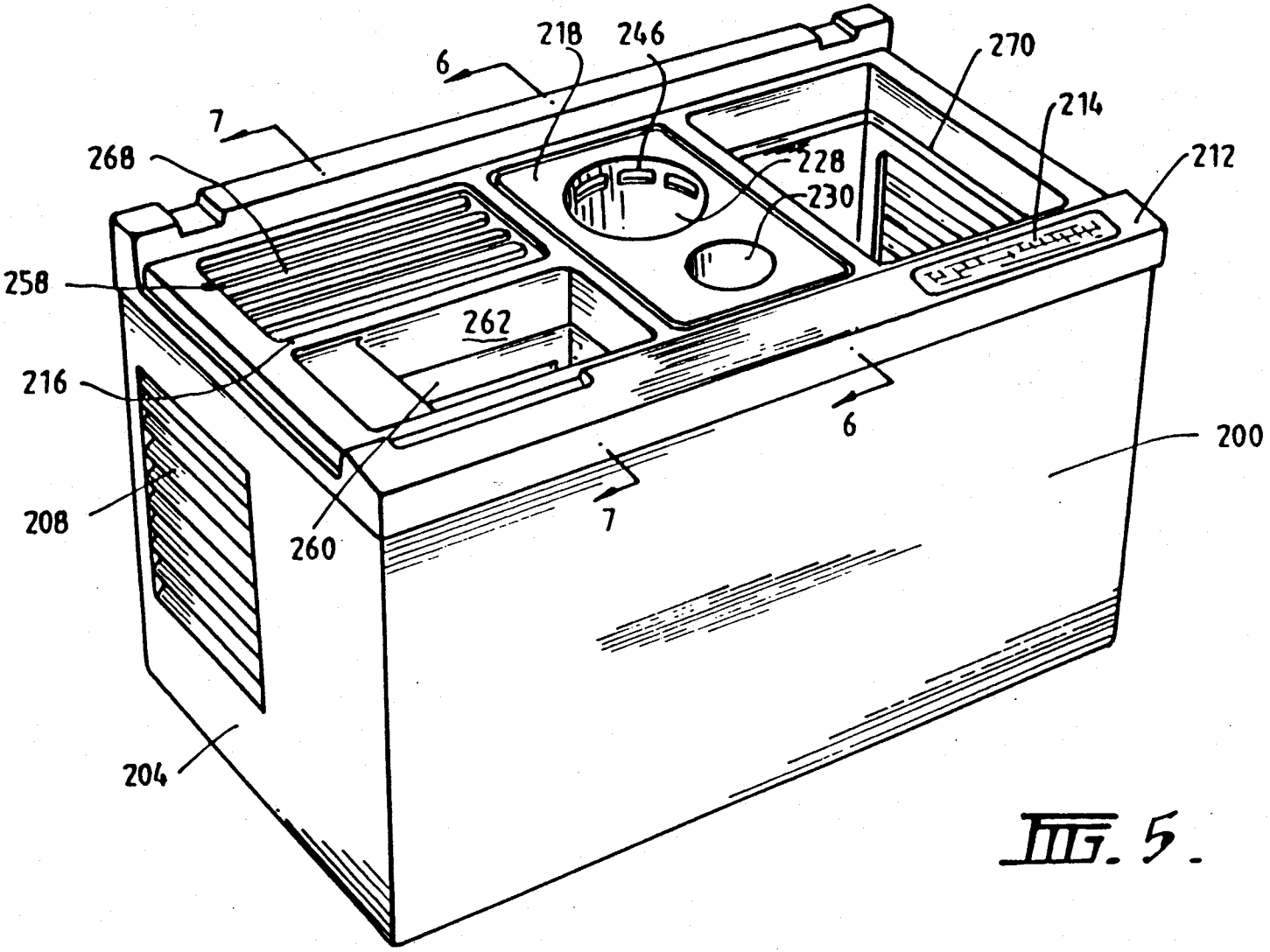
FIG. 5 is a perspective view of a second embodiment of a chilling apparatus incorporating the preferred features of the present invention.
Figure 6:
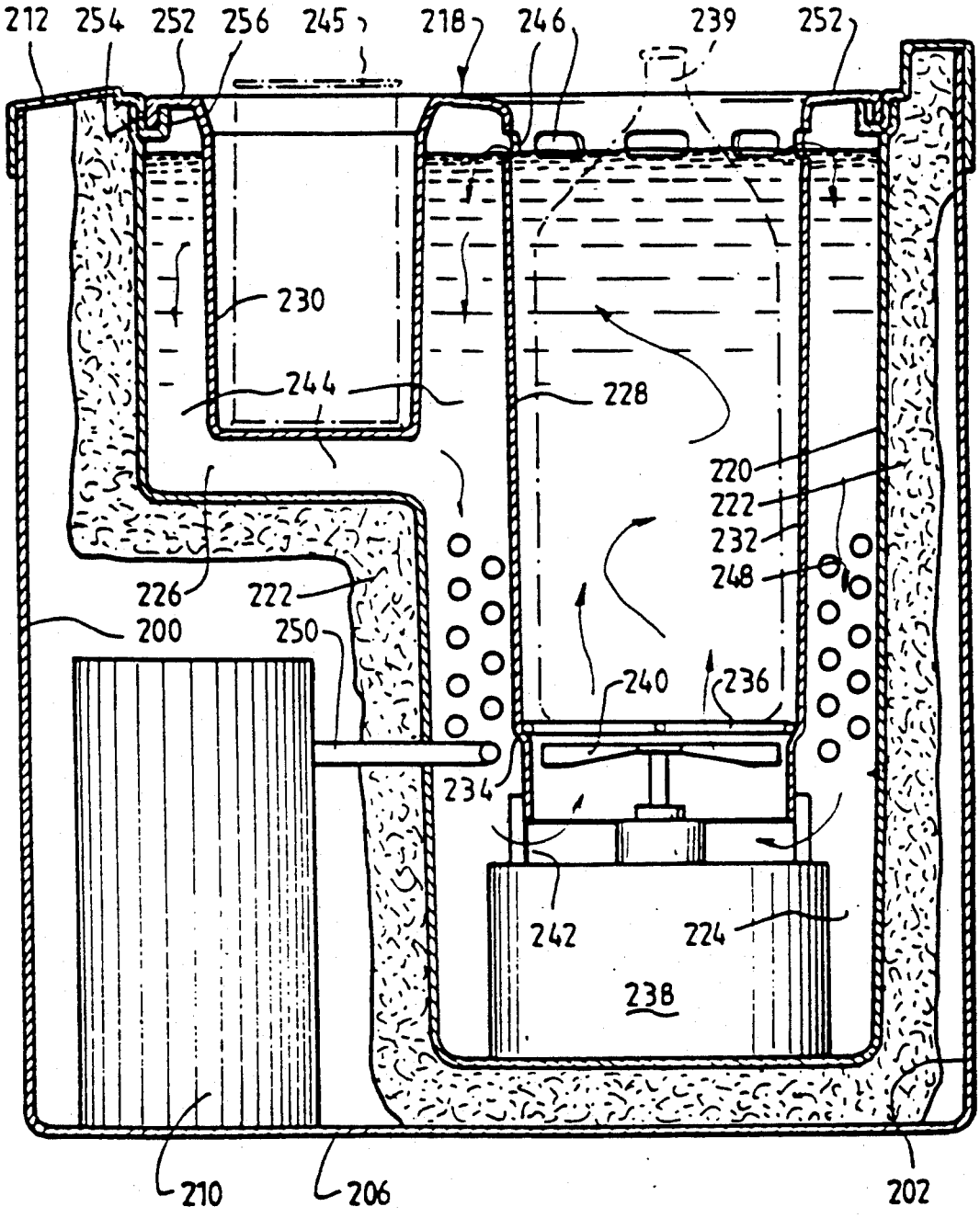
FIG. 6 is an enlarged cross-sectional view along the lines of and in the direction of arrows 6—6 on FIG. 5.
Figure 7:
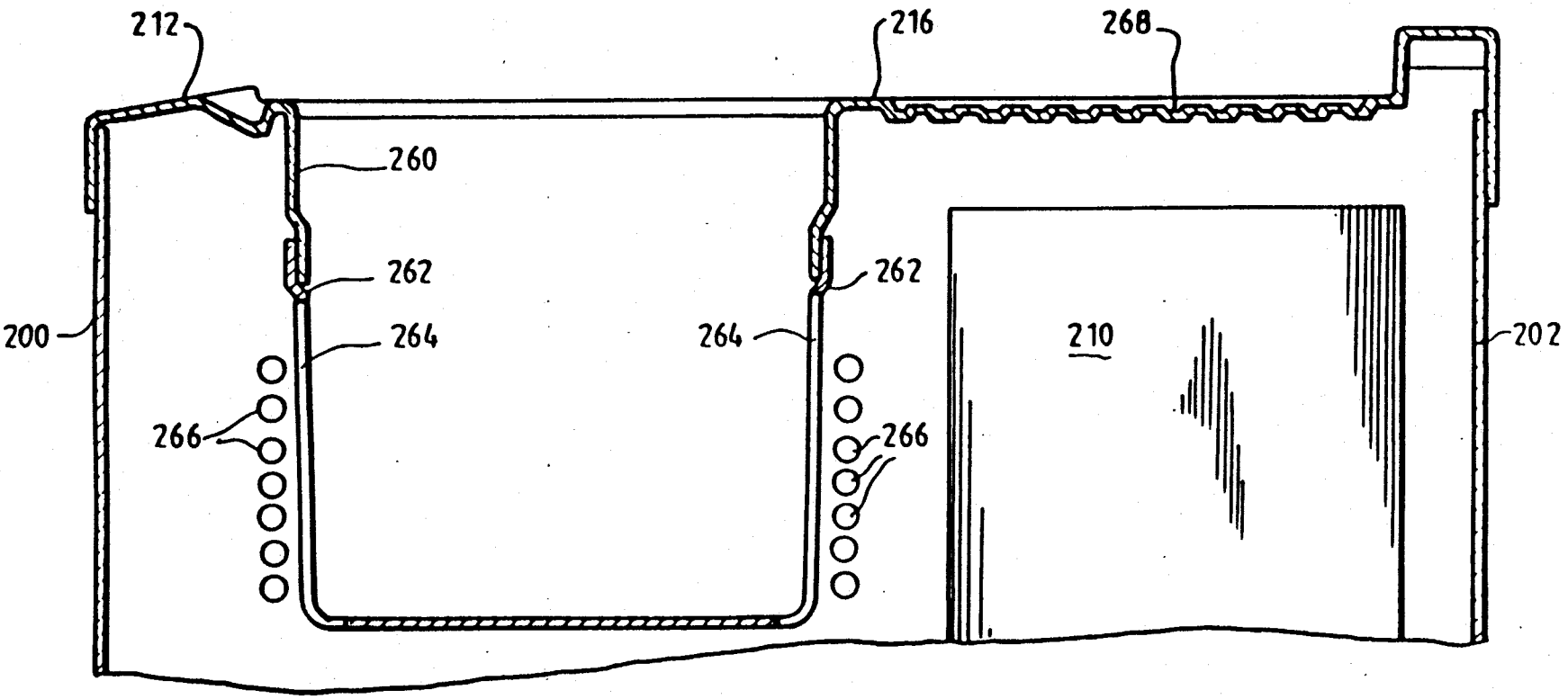
FIG. 7 is an enlarged cross-sectional view along the lines of and in the direction of arrows 7—7 on FIG. 5.

To now consider the embodiment of FIGS. 5 to 7, there is shown a chilling apparatus contained within a cabinet having front wall 200, rear wall 202, side walls 204, and a base 206. At least one of the side walls 204 has a louvred section 208 to allow cooling air to circulate to cool the refrigeration system 210. The refrigeration system 210 is standard in design and will not be described in detail.

The cabinet has a top 212 which may have a lid (not shown) if desired. A control panel 214 is located in the top 212. The top 212 also has a central panel 216 in which are located the chilling compartments.

The first chilling compartment is generally designated as 218 and comprises an outer or main bowl 220 having insulation 222 wrapped around it. The main bowl 220 is parallelpipedal-shaped in that it has a deeper portion 224 and a shallower portion 226. Located in the main bowl 220 are two inner bowls 228, 230. The inner bowls 228, 230 may be separate components or, as shown, may be integral. The inner bowl 228 is located in the deeper portion 224 and has a side wall 232 with an indented portion 234 so as to allow a grille 236 or the like to rest therein. The grille 236 is adapted to hold a bottle 239 or the like. Located below the grille 236 is a motor 238 which drives an agitator or impeller 240. The lower end of side wall 232 contacts motor 238, but a plurality of openings 242 are provided. This allows a coolant fluid 244 which almost fills the main bowl 220 to pass through the openings 242 and, under the influence of the impeller 240, pass up into the inner bowl 228 and past the bottle 238. The side wall 232 has a plurality of openings 246 therethrough just below the top thereof to enable the fluid 244 to pass therethrough. The fluid 244 can then cycle continuously under the influence of the impeller 240.

The second inner bowl 230 is smaller than the inner bowl 228 and as it is located in the shallow part 226 of main bowl 220, is also shorter. Whereas the first inner bowl 228 is intended for products such as bottles 239 or the like, the second inner bowl 230 is intended for cans 248 or the like. Also, unlike the first inner bowl 228, the second inner bowl 230 is sealed against flow therethrough of the fluid 244. This will mean the cooling time for the can in bowl 230 will be approximately the same as for the bottle 239 in bowl 228.

To cool the fluid 244 there is provided a coil or coils 248 in the gap between side wall 232 and main bowl 220. In this way, fluid 244 passing through openings 246 must flow past coil 248 before reaching openings 246. This assists the cooling of fluid 244. The coil 248 contains a suitable refrigerant, and is connected to the refrigeration system 210 by pipes 250.

The bowls 228, 230 each have a roll-over rim 252 which seal in a gasket 254 located in a channel 256 in top 212.

The second chilling compartment is a refrigerated storage area and is generally designated 258 and comprises a generally rectangular bowl 260 integral with or securely attached to the central panel 216 of top 212. The side walls 262 of the bowl 260 may have openings 264 therethrough. Adjacent the openings 264 are coils or coil 266 which, like coil 248, is operatively connected to the refrigeration system 210. This causes cooling of the bowl 260 and any contents thereof. Therefore, any objects placed in bowl 260 will be kept cool, but would not be cooled as quickly as if in the second bowl 228 of first compartment 218. A drainage area 268 is provided which may have openings to allow any fluid 244 which may collect there to be returned to the main bowl 220 of first compartment 218. Alternatively, the bowl 260 may have a heat conductive panel instead of openings 264, or the entire bowl 260 may be heat conductive.

The third compartment is a further refrigerated storage area and is designated as 270. It comprises a large, rectangular bowl. As its construction and operation are substantially the same as for bowl 260, it will not be described in any detail.

For both embodiments the number, size and location of the openings 76, 246 is balanced with the nature of the cooling fluid, the temperature of the cooling fluid, and the chilling requirements. Obviously, to require a lower temperature of the chilled product would require lower cooling fluid temperature, and higher lower flow rates. Similarly, a higher cooling fluid temperature would require decreased cooling fluid flow. This balance can be calculated throughout the temperature range of from −30° C. to +2° C. Below −30° C. instant chilling takes place and ices can form internally, an unacceptable result. Above +2° C. a temperature differential cannot be maintained and, in the result, the product cannot be cooled in a short time.

Insofar as actual operation of the chilling apparatus in accordance with the invention is concerned, the electronic control panels and associated circuitry are made up of a number of timing circuits, with the number of circuits depending upon the results to be achieved, which are individually timed to enable an operator to place and chill one or two bottles, for example, at any one time. It would also allow for bottles to be introduced at random intervals. Preferably there would be included time determining devices and appropriate warning means of any suitable type, so that an appropriate indicator—be it visual and/or auditory—could be used to indicate when the bottle or beverage container had reached the required temperature. A power supply panel provides a relatively low voltage power to the circuit and a thermostat is fitted to cycle the refrigeration system.

The cooling fluid is preferably of food grade quality, such that the use of that medium with an open top does not create any difficulties. This could be, for example, a propylene glycol based formulation, which has the advantage of being anti-corrosive. Alternatively, a sodium chloride solution could be used, but this is highly corrosive.

In the case of chilling wine, beer or other beverages, the equipment cost is significantly less, running and maintenance costs are improved, and the time versatility is extremely great. In other words, if a person wanted a bottle of a particular wine it would merely have to be taken from the rack, chilled for a few minutes and then served. The host would not have to keep a large amount of wine in storage in a refrigerated area and then try and anticipate his guests' requirements. This would also assist in increasing the length of storage life of the wine.

It would take approximately two hours for the refrigeration system to chill the cooling medium down to approximately −20° C. and then to cycle for about forty per cent of the time until warm product is introduced, and then will cycle on demand. The machine in accordance with the present invention need be run continuously while there is a need for cooling and it is envisaged that it will replace the bar fridge.

It should be evident that the chilling apparatus of the present invention lends itself to usage in such areas as small retail liquor outlets, low-turnover fast food outlets, restaurants, cafes and bistros, hospitals, (for food or blood), on a domestic scale to save refrigerator space, to manufacture small quantities of ice, to freeze small quantities of packaged foods such as meats, vegetables, fruits and the like, in freeze shrinking of metals for interference fitting of parts etc., and in any other application where quick and effective chilling or freezing is required.

It is to be understood that the aforegoing description refers merely to preferred embodiments of the invention, and that variations and modifications will be possible thereto without departing from the spirit and scope of the invention.

The claims defining the invention are as follows:

I claim:

1. Apparatus for the chilling of articles, said apparatus including a refrigeration system; a container having a main bowl in which a cooling fluid is located; an inner bowl within said main bowl, said inner bowl having a side wall with at least one opening therethrough adjacent the top of said side wall to allow said cooling fluid to pass therethrough into a gap between said side wall and said main bowl, said inner bowl having at least one hole therethrough at its lower end, said hole being operatively connected to said gap; circulation means in one of said bowls for assisting circulation of said cooling fluid; and cooling means in said one bowl for cooling said cooling fluid, the circulation means comprising an electric motor and impeller both submerged in the cooling fluid, and the impeller causing circulation of fluid by lifting and agitating the fluid.

2. Apparatus as claimed in claim 1, wherein said inner bowl has a base, said at least one hole being in said base.

3. Apparatus as claimed in claim 2, wherein said circulation means is mounted on said base of said inner bowl.

4. Apparatus as claimed in claim 1, wherein said cooling means comprises at least one coil operatively connected to said refrigeration system.

5. Apparatus as claimed in claim 4, wherein said coil is located in said gap.

6. Apparatus as claimed in claim 2, wherein said cooling means comprises at least one coil operatively connected to said refrigeration system.

7. Apparatus as claimed in claim 2, wherein said at least one coil is located below said base and is substantially co-axial with said at least one hole.

8. Apparatus as claimed in claim 1, wherein said side wall has a ledge intermediate its height, there being provided spacing means for resting on said ledge, said ledge being above said circulation means.

9. Apparatus as claimed in claim 8, wherein said spacing means is a grille.

10. Apparatus as claimed in claim 1, wherein there is provided a basket for the holding of said articles, said basket being receivable in said inner bowl.

11. Apparatus as claimed in claim 1, wherein there is provided a second inner bowl within said main bowl, said second inner bowl being sealed against ingress thereto by said cooling fluid.

12. Apparatus as claimed in claim 1, wherein there is further provided a compartment, said compartment having at least one side wall with at least one heat conductive area, there being provided at least one further cooling coil located adjacent said at least one heat conductive area, said at least one further cooling coil being operatively connected to said refrigeration system.

* * * * *